US005332170A

United States Patent [19]

Dittly

[11] Patent Number: 5,332,170

[45] Date of Patent: Jul. 26, 1994

[54] METHOD AND DEVICE FOR FASTENING THE YARN END OF A BOBBIN

[75] Inventor: Claude Dittly, Kingersheim, France

[73] Assignee: Superba, Mulhouse, France

[21] Appl. No.: 932,566

[22] Filed: Aug. 20, 1992

[51] Int. Cl.[5] ..... B65H 65/00; B65H 55/00

[52] U.S. Cl. ..... 242/18 EW; 242/164

[58] Field of Search ..... 242/18 EW, 35.6 E, 35.6 R, 242/18 R, 164

[56] References Cited

U.S. PATENT DOCUMENTS

| | | | |
|---|---|---|---|
| 3,595,491 | 7/1971 | Bourque | 242/18 EW X |
| 3,652,025 | 3/1972 | DiMauro | 242/18 EW X |
| 4,084,767 | 4/1978 | Witt | 242/164 |
| 4,630,782 | 12/1986 | Rohner | 242/18 EW |
| 4,848,077 | 7/1989 | Kawarabashi et al. | 242/35.6 E |
| 4,909,451 | 3/1990 | Kuepper et al. | 242/35.6 E X |
| 5,082,192 | 1/1992 | Langen et al. | 242/18 R |
| 5,104,052 | 4/1992 | Wey et al. | 242/18 R |
| 5,106,027 | 4/1992 | Wirtz et al. | 242/18 R |
| 5,131,437 | 7/1992 | Shaw et al. | 242/35.6 E X |

FOREIGN PATENT DOCUMENTS

| | | | |
|---|---|---|---|
| 0386339 | 9/1990 | European Pat. Off. . | |
| 79245 | 1/1971 | Fed. Rep. of Germany . | |
| 2442471 | 3/1976 | Fed. Rep. of Germany | 242/18 EW |
| 2059167 | 5/1971 | France . | |
| 2321446 | 3/1977 | France . | |
| 58-82958 | 5/1983 | Japan . | |

*Primary Examiner*—Stanley N. Gilreath
*Attorney, Agent, or Firm*—Young & Thompson

[57] ABSTRACT

A method for fastening a yarn end (2) on a bobbin (1), comprises placing the bobbin (1) horizontally on two spaced supports which support the bobbin along two lines parallel to the axis of the bobbin. A partial vacuum is created in a space located near the bobbin (1), the partial vacuum being sufficient to suck the non-fastened yarn end (2) into that space. The bobbin is caused to rotate in order to wind the non-fastened yarn end (2) on the bobbin. The yarn end (2) is fastened on the bobbin (1). While step (b) is being performed, the bobbin (1) is rotated at the same time in order to unwind the non-fastened yarn end (2) so that this end can engage by suction to a sufficient extent within the space located near the bobbin (1).

9 Claims, 4 Drawing Sheets

METHOD AND DEVICE FOR FASTENING THE YARN END OF A BOBBIN

BACKGROUND OF THE INVENTION

1. Field of the Invention

The present invention relates to a method for fastening the yarn end of a bobbin.

The invention is also concerned with a device for carrying out said method.

2. Description of the Prior Art

Bobbins of textile yarns are formed automatically on winding machines.

At the exit of these winding machines, the bobbins are conveyed continuously on a belt conveyor towards an unloading station at which an operator unloads them.

After unloading, the following operations also have to be performed by the operator:

1) the yarn end which has unwound during displacement of the bobbin on the belt conveyor has to be rewound on the bobbin;

2) a knot has to be tied at this yarn end in order to fasten it to the bobbin and to prevent subsequent unwinding;

3) the bobbins have to be stored.

Moreover, identification of the bobbins is at present carried out by means of labels applied on the internal tube faces of the spools on which the yarn is wound.

However, these labels cannot readily be seen, particularly from a distance, with the result that it is difficult to detect a possible error due to mixing of bobbins which carry yarns of different batches.

The aim of the present invention is to overcome the above-mentioned disadvantages by creating a method which permits easy and automatic fastening of the yarn end on bobbins while facilitating the identification of these bobbins.

SUMMARY OF THE INVENTION

In accordance with the invention, the method for fastening a yarn end on a bobbin involves the following steps:

a) a partial vacuum is created between two spaced supports, b) the bobbin is placed on the two supports. The partial vacuum created between these two supports is sufficient to suck the non-fastened yarn end into the space located between these two supports, c) the bobbin is caused to rotate in order to wind the non-fastened yarn end on the bobbin, and d) said yarn end on the bobbin is fastened by adhesive means.

This method is characterized in that, while step (b) is being performed, the bobbin is caused to rotate at the same time in order to unwind the non-fastened yarn end so that this latter can engage by suction to a sufficient extent within the space located between the two supports, with the result that the sucked-in yarn end can be drawn tight between the two supports.

The adhesive means employed can be an adhesive label which not only fastens the yarn end to the bobbin but also serves to identify this latter. In view of the fact that the label is adhesively applied on the external surface of the bobbin, said label can be seen from a long way off, thus facilitating the detection of an error.

In an advantageous embodiment of the invention, while step (c) is being performed, the yarn end is guided at the same time towards the center of the bobbin.

This operation makes it possible to fasten the yarn end at the center of the bobbin, for example by means of a label which covers only a small portion of the bobbin surface.

The invention is also concerned with the device for carrying out the method in accordance with the invention.

In an advantageous embodiment, the method for fastening a yarn end on a bobbin which involves the following steps:

a) creating a partial vacuum between two spaced supports;

b) placing the bobbin on these two supports, the partial vacuum being sufficient to suck the non-fastened yarn end into the space located between these two supports;

c) causing the bobbin to rotate in order to wind the non-fastened yarn end on the bobbin; and d) fastening said yarn end on the bobbin, is distinguished by the fact that, in order to fasten this yarn end:

the bobbin is caused to rotate so as to bring the yarn end opposite to a suction nozzle;

said yarn end is sucked into said nozzle;

a needle provided with an end-hook is inserted in a corner of the bobbin in the direction of the yarn which is engaged in the nozzle and transversely to said yarn;

the yarn is engaged in the hook of the needle; and the needle is withdrawn from the bobbin in order to engage the yarn between the yarn windings of said corner of the bobbin.

The yarn end is thus held captive between the yarn windings of one of the corners of the bobbin. This method permits efficient fastening of the yarn end to the bobbin and thus makes it possible to overcome the disadvantage attached to the application of a label in order to perform this fastening operation.

The invention is also concerned with a device for carrying out the method according to the invention.

In accordance with the invention, this device comprises:

means for successively bringing bobbins onto two spaced supports, means for producing a partial vacuum between these two supports and sucking the non-fastened yarn end into the space located between the two supports, means for causing rotation of the bobbin relatively to the two supports in order to unwind and wind the yarn end, and means for fastening said yarn end on the bobbin by making use of adhesive means or the like.

The device is capable of operating independently or in association with a winding machine from which the belt conveyor brings the bobbins successively onto the two spaced supports of the device in accordance with the invention.

In a preferred embodiment of the invention, the two spaced supports are constituted by two parallel rotating rollers which support each bobbin along two generator-lines of this latter.

The two rollers are thus capable of driving the bobbin in rotation in one direction or another in accordance with the steps involved in the method according to the invention.

In an advantageous embodiment of the invention, the means for producing a partial vacuum include a suction nozzle which is flared at the top and placed between the two supports.

The device for the practical application of the method according to the invention can also comprise:

a suction nozzle which opens in proximity to the bobbin;

means for causing rotation of the bobbin in order to bring the yarn end opposite to the suction nozzle;

a support so arranged that a needle which carries an end-hook is maintained by said support in proximity to a corner of the bobbin in a direction which passes through said corner and passes in proximity to the suction nozzle, said support being provided with means for displacing the needle in the aforementioned direction and for returning it to its initial position.

Thus the needle passes through one of the corners of the bobbin, whereupon its hook engages with the yarn end and then, during its displacement in the opposite direction, the needle draws the yarn end and engages it between the yarn windings of the bobbin.

In an advantageous embodiment of the invention, the suction nozzle opens on the top portion of the bobbin and the needle is placed near a top corner of said bobbin.

Preferably, the nozzle has a suction slit parallel to the axis of the bobbin and extending substantially over the entire length of this latter.

In consequence, the nozzle is capable of sucking the yarn into its interior irrespective of the position of the yarn end on the bobbin.

In accordance with a preferred feature of the invention, the nozzle is mounted so as to be capable of pivoting about an axis parallel to that of the bobbin between a position in which its suction opening is spaced from the bobbin and a position in which said opening is substantially in contact with the bobbin.

When it has reached the last position mentioned above, the nozzle brings the yarn end into contact with the needle, thus enabling the needle hook to engage with the yarn at the time of displacement of the needle to its initial position.

Other features and advantages of the invention will further become apparent from the description given below.

BRIEF DESCRIPTION OF THE DRAWINGS

In the accompanying drawings which are given by way of non-limitative example.

DETAILED DESCRIPTION OF THE INVENTION

There will first be described the device for the practical application of the method in accordance with the invention and this method will then be described at the same time as the operation of the device.

Figure 1:
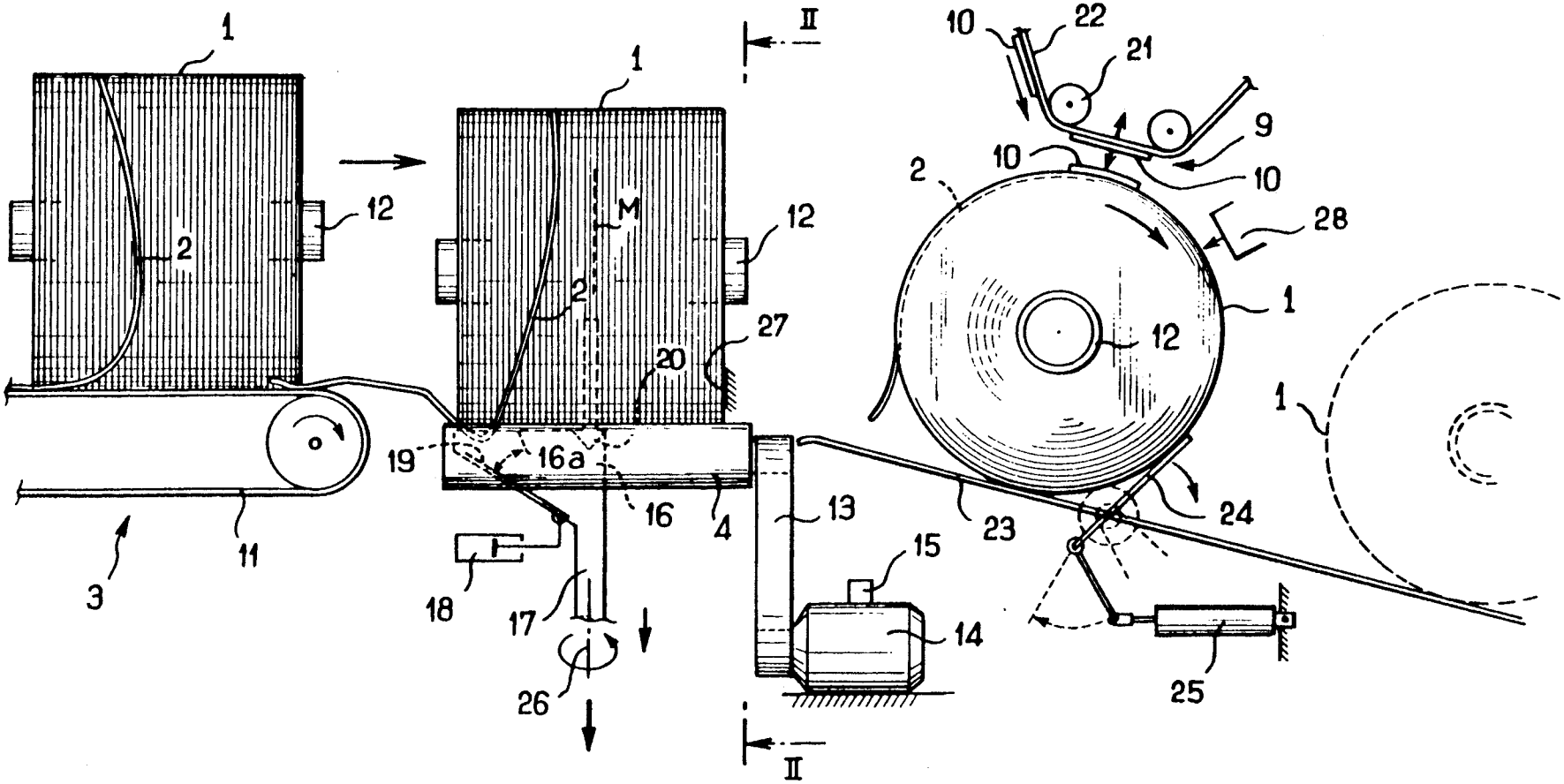
FIG. 1 is a general diagrammatic view of the device in accordance with the invention.

In FIG. 1, there is shown a bobbin 1 after discharge from a winding machine in which it has been formed. The end 2 of the yarn of this bobbin 1 is not attached to this latter and hangs loosely from one side of the bobbin.

In a general manner, the device for fastening the yarn end 2 to the bobbin 1 comprises (see FIGS. 1 and 2) :

means 3 for successively bringing bobbins 1 onto two spaced supports 4, 5, means 16 for producing a partial vacuum between these two supports 4, 5, said means being capable of sucking the non-fastened yarn end 2 into the space 7 located between the two supports 4, 5, means 14, 15 for causing the bobbin 1 to rotate relatively to the two supports 4, 5 in order to unwind and to wind the yarn end 2, means 9 for fastening said yarn end 2 on the bobbin 1 by making use of adhesive means 10.

In the embodiment shown in FIG. 1, the means 3 for successively bringing bobbins 1 onto the two spaced supports 4, 5 include a belt conveyor 11 for supporting and displacing the bobbins 1 in the direction of the axis of their tubular spool 12.

Figure 2:
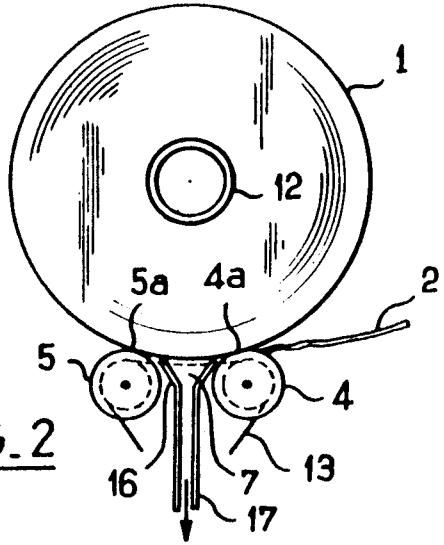
FIG. 2 is a sectional view taken along the plane II—II of FIG. 1.

In this example, the two spaced supports consist of two parallel rotating rollers 4, 5 which support each bobbin along two generator-lines 4*a*, 5*a* of this latter (as shown in FIG. 2).

These two rotating rollers 4, 5 are coupled by means of a driving-belt 13 or the like so that they can rotate in the same direction about their respective axes. Said belt 13 is driven by an electric motor 14 equipped with a device 15 for reversing the direction of rotation, with the result that the rollers 4, 5 can rotate either in one direction or in the opposite direction as will be described in detail hereafter.

The means for producing a partial vacuum beneath the bobbin 1 and between the rollers 4, 5 include a suction nozzle 16 which is flared at its upper end and placed between the two rollers 4, 5, the lower end 17 of said nozzle 16 being connected to a vacuum pump (not shown in the drawings).

It is apparent from FIGS. 1 and 2 that the flared upper end of the nozzle 16 extends over substantially the full width of the space 7 located between the two rollers 4, 5 and over the first half of the length of the bobbins 1.

The device in accordance with the invention comprises in addition means 18 for guiding the yarn end 2 towards the center M of the bobbin 1 while said yarn end 2 is being wound on the bobbin 1 at the same time.

Figure 5:
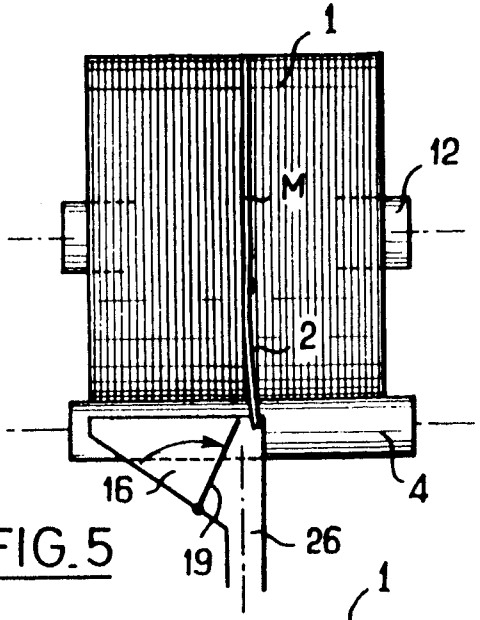
FIG. 5 is a view from the left of FIG. 4.

In the example shown in the drawings (see FIGS. 1 and 5), these means include a flap or arm 19 for guiding the yarn into a position located at the center M of the bobbin 1 (as shown in FIG. 5).

In an alternative embodiment, the means for guiding the yarn towards the center M of the bobbin are constituted by a notch 20 (see FIG. 1) formed at the center of one of the edges 16*a* of the suction nozzle 16 adjacent to one (4) of the rollers 4, 5.

Moreover, in the example of FIG. 1, the means for fastening the yarn end 2 on the bobbin 1 include a movable element 21, 22 for continuously applying an adhesive label 10 under pressure on said yarn end 2 and the bobbin 1.

The movable element 21, 22 is provided for this purpose with rotating guide-rollers 21 which support and displace a strip 22, said strip being adapted to carry on its outer face uniformly spaced labels 10 having an adhesive outer face. The movable element 21, 22 is capable of moving between a position in which it is withdrawn from the bobbin 1 (position shown in FIG. 1) and a position in which it presses a label 10 on the bobbin 1 in order to fasten the yarn end 2 on this latter.

It is also apparent from FIG. 1 that a downwardly inclined ramp 23 on which the bobbins 2 can roll extends downstream of the rollers 4, 5 and the suction nozzle 16.

The ramp 23 has a movable stop 24 which is capable of arresting a bobbin 1 by projecting from the surface of the ramp as indicated in FIG. 1. This stop 24 is controlled by a jack 25 which is capable of producing a downward pivotal displacement of said stop to a withdrawn position in which the bobbin 1 is again permitted to roll on the ramp 23 towards a storage position.

In the position in which the bobbin 1 is arrested on the ramp 23, the movable element 21, 22 can be put into action so as to press a label 10 on the bobbin 1.

In the example illustrated in FIG. 1, the ramp 23 is located in the direction of the axis of the bobbin 1 which is in position on the two rollers 4, 5. To this end, the rollers 4, 5, the driving motor 14 and the suction nozzle 16 must be mounted for rotation about a vertical axis 26 in order to be capable of bringing the axis of the bobbin 1 into a position at right angles to the direction of the ramp 23 so that the bobbin can roll on this latter.

As will be readily apparent, the rotary assembly described above serves no purpose if the ramp 23 is placed at right angles to the axis of the bobbin 1 which is in position on the rollers 4, 5.

The operation of the device described in the foregoing will now be explained.

The belt conveyor 11 deposits the bobbins 1 successively on the rollers 4, 5. Perfect positioning of a bobbin 1 on the rollers 4, 5 is defined by a stop 27 shown diagrammatically in FIG. 1. The bobbin 1 then occupies the position illustrated in FIGS. 1 and 2. The yarn end 2 of the bobbin extends to a certain distance from the bobbin 1.

Figure 3:
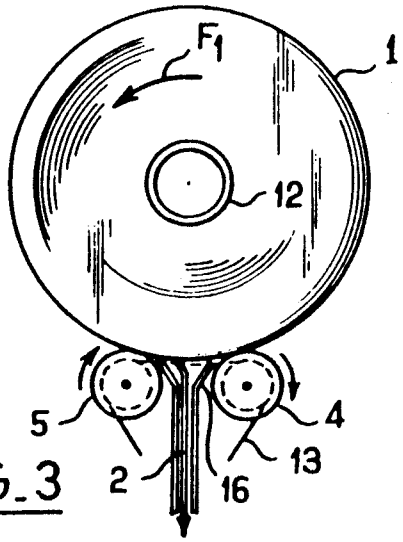
FIG. 3 is a view which is similar to FIG. 2 and shows a subsequent stage of operation of the device.

A partial vacuum is created within the nozzle 16 which sucks the yarn end 2 into said nozzle 16 as indicated in FIG. 3.

Rotation of the rollers 4 and 5 is then initiated. The bobbin 1 is thus driven by said rollers in the direction of the arrow F1 of FIG. 3, which has the effect of unwinding the yarn end 2. The yarn end 2 thus engages to a greater extent within the nozzle 16 in which it is subjected to slight tension as a result of the suction.

Figure 4:
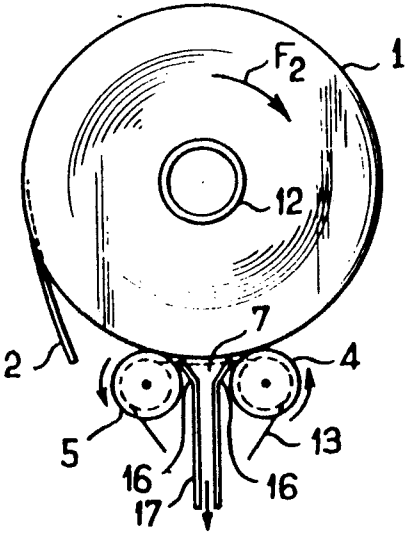
FIG. 4 is a view which is similar to FIG. 3 and shows the following stage of operation of the device.

Then, while maintaining the suction, the flap 19 is raised (as shown in FIG. 5) and the direction of rotation of the rollers 4 and 5 is reversed so as to cause the bobbin 1 to rotate in the direction of winding (arrow F2) as indicated in FIG. 4.

The new position of the flap 19 centers the yarn end 2 which passes out of the nozzle 16 and is wound in the central portion of the bobbin 1.

The rotation of the rollers 4, 5 and the suction are then stopped.

The complete unit is then caused to rotate through an angle of 90° about the vertical axis 26 and the bobbin 1 is pushed onto the ramp 23 on which it is arrested by the movable stop 24, then labeled.

Figure 6:
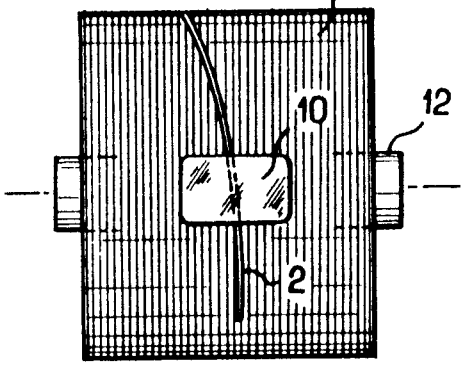
FIG. 6 is a side elevational view showing the labeled bobbin.

The label 10 is pressed on the yarn end 2 and on the bobbin 1 as shown in FIG. 6 and makes it possible both to fasten said end 2 and to identify the bobbin 1.

Said label 10 can easily be seen, thus facilitating inspection and guarding against any danger of error, that is to say of mixing or confusion of bobbins having threads of different kinds.

As will be readily understood, the operation of the successive steps which have just been described can be made fully automatic by making use of means which are well-known to those versed in the art.

As will be readily understood, the invention is not limited to the examples of construction which have been described and many modifications can be made in these latter without departing from the scope of the invention.

Thus the labeling operation can be replaced by a banding operation which would permit even easier identification of bobbins.

Moreover, the function of fastening of the yarn end 2 and the function of identification could be separate and performed in two steps : position of any suitable adhesive means followed by positioning of marking means.

Furthermore, identification by means of labels can be completed by spraying of a paint by means of a spraygun 28 (see FIG. 1).

Figure 7:
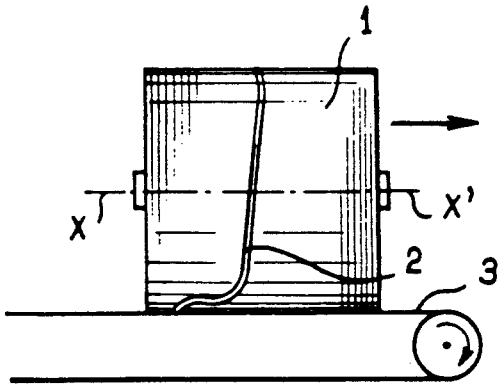
FIG. 7 is a side elevational view of a bobbin of yarn in position on the end of a belt conveyor.
Figure 8:
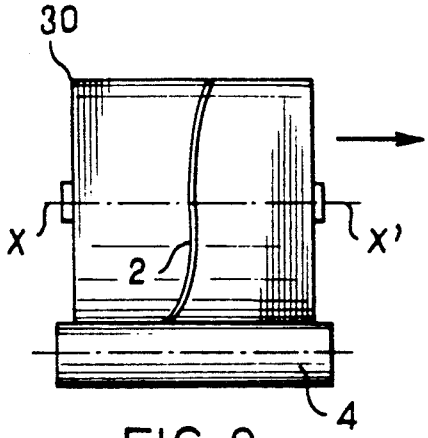
FIG. 8 is a side elevational view that shows the bobbin in position on the device in accordance with the invention.
Figure 9:
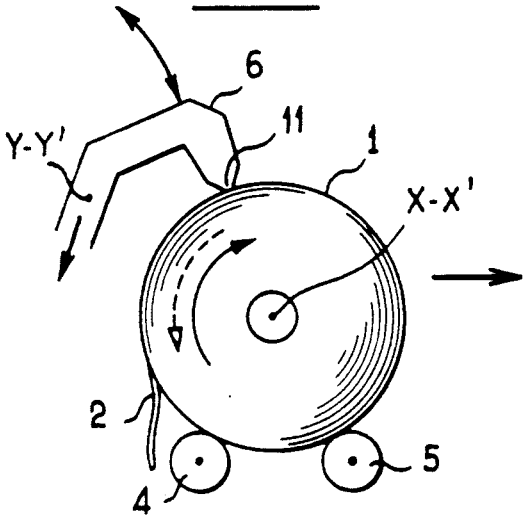
FIG. 9 is an end elevational view of the bobbin showing the suction nozzle and the yarn end which is still located at a distance from the nozzle.

In another embodiment of the invention (see FIG. 7), the bobbin 1 arrives with its hanging yarn end 2 at the end of the conveyor belt 3 (see FIG. 1), whereupon said bobbin is placed on two rotating rollers 4, 5 which permit rotation of the bobbin 1 about its axis X-X' (see FIGS. 8 and 9).

Figure 10:
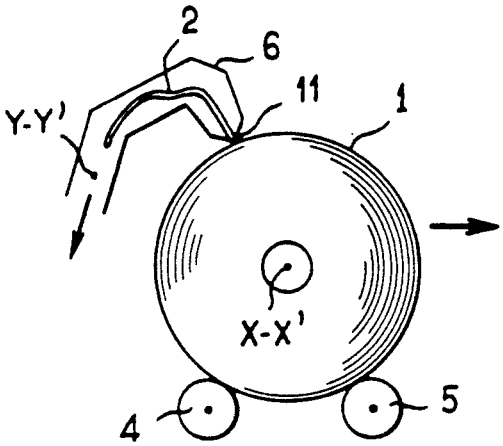
FIG. 10 is a view which is similar to FIG. 9, the yarn end having been sucked into the nozzle.

The device for attaching the yarn end 2 to the bobbin 1 essentially comprises:

a suction nozzle 6 which has its opening close to the bobbin 1 (see FIGS. 9 and 10) ;

rollers 4, 5 for driving the bobbin 1 in rotation so as to bring the yarn end 2 into position opposite to the suction nozzle 6;

a support 7 (see FIG. 12) for maintaining a needle 8 carrying an end-hook 9 in proximity to a corner 30 of the bobbin 1 in a direction D which extends through the corner 30 (see FIG. 13) and passes in proximity to the suction nozzle 6.

The support 7 comprises means such as a hydraulic or pneumatic actuator in order to displace the needle 8 in the above-mentioned direction D and to return it to the initial position in which it is withdrawn from the bobbin 1.

As is apparent from FIGS. 8 to 14, the suction nozzle 6 opens on the top portion of the bobbin 1 and the needle 8 is placed near a top corner 30 of said bobbin 1.

Figure 12:
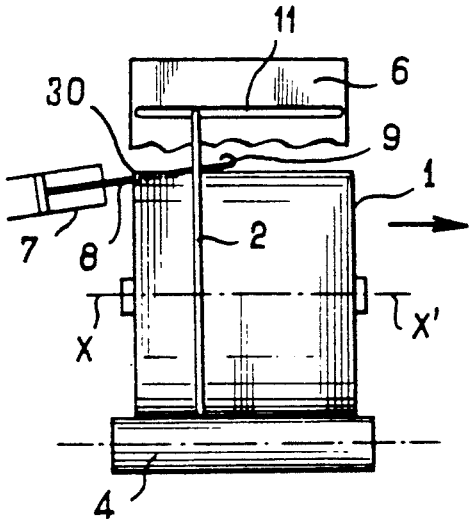
FIG. 12 shows is a side elevational view that the bobbin in the direction of its length as well as the needle which has passed through a top corner of the bobbin.

Moreover, as shown in FIG. 12, the nozzle 6 has a suction slit 11 which is parallel to the axis X-X' of the bobbin 1 and extends substantially over the entire length of this latter.

Furthermore, the nozzle 6 is mounted so as to be capable of pivoting about an axis Y-Y' which is parallel to that of the bobbin 1 between a position (see FIG. 11) in which its suction opening 11 is spaced from the bobbin 1 and a position (shown in FIGS. 9, 10 and 14) in which said opening 11 is substantially in contact with the bobbin 1.

Figure 13:
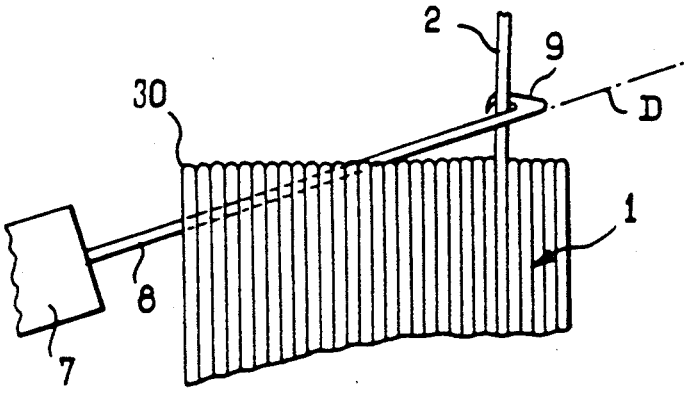
FIG. 13 is an enlarged side elevational view of the top corner of the bobbin and of the needle.
Figure 14:
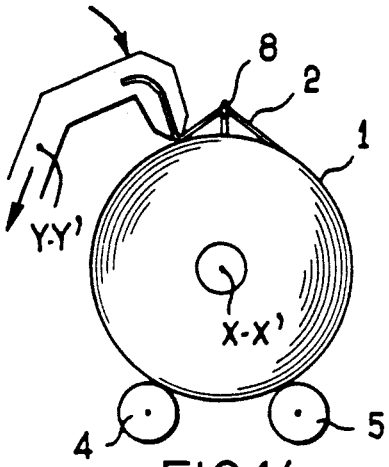
FIG. 14 is an end side elevational view of the bobbin showing a subsequent position of the nozzle, of the yarn and of the needle.

As shown in FIGS. 12, 13 and 14, the direction D of displacement of the needle 8 passes slightly beneath the yarn end 2 which is maintained within the suction nozzle 6 when this latter is spaced from the bobbin 1.

It is also seen that the hook 9 of the needle 8 is oriented in the upward direction (see FIGS. 12 and 13).

Moreover, when the opening 11 of the suction nozzle 6 is substantially in contact with the bobbin 1 (see FIG. 14), the yarn end 2 which is held within said nozzle 6 is applied against the needle 8.

Furthermore, the suction nozzle 6 encloses a detector (not shown) which is sensitive to the presence of the yarn end 2 within said nozzle. Said detector is adapted to initiate stopping of rotation of the bobbin 1 in the positions shown in FIGS. 10 to 12 and 14, 15.

In addition, the support 7 of the needle 8 is provided with means (see arrow F of FIG. 15) for causing the needle 8 to rotate about its axis by one-quarter of a revolution when said needle moves to its initial position.

The operation of the above device will now be described.

In its initial position, the nozzle 6 is substantially in contact with the top portion of the bobbin 1 as indicated in FIG. 9 and the needle 8 is in the withdrawn position.

The bobbin 1 being in position on the rollers 4, 5, it is rotated in order to drive the bobbin 1 in rotation (see FIG. 9) so as to bring the yarn end 2 close to the suction nozzle 6.

When the yarn end 2 arrives opposite to the nozzle 6, this latter sucks it into the nozzle (see FIG. 10). The detector detects the presence of the yarn 2 and initiates stopping of rotation of the bobbin 1 which thus remains stationary throughout all the remaining operations.

Figure 11:
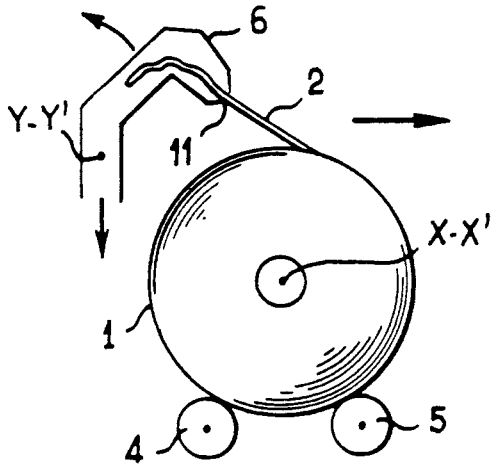
FIG. 11 is a view similar to FIGS. 9 and 10 that shows the suction nozzle in a position in which it is withdrawn from the bobbin.

By means of an actuator (not illustrated), the nozzle 6 is then caused to pivot to the spaced position of the bobbin 1 shown in FIG. 11, which has the effect of lifting the yarn end 2 from the bobbin 1.

In a subsequent step (see FIG. 12), the needle 8 is caused to move towards a top corner 30 of the bobbin 1. Said needle 8 passes through the corner 30 and its hook 9 projects from the top face of the bobbin by passing beneath the yarn 2.

One then initiates a pivotal displacement of the nozzle 6 (see FIG. 14) towards the bobbin 1, which has the effect of applying the yarn 2 against the needle 8.

Figure 15:
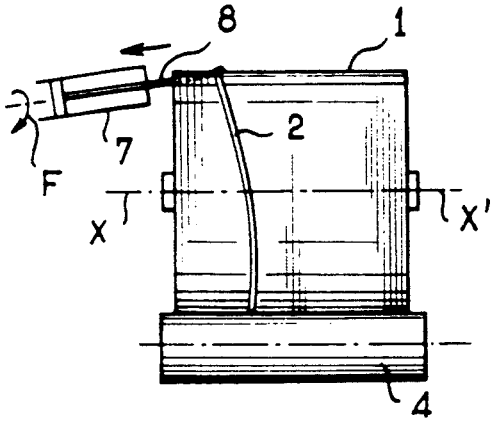
FIG. 15 is another side elevational view of the bobbin showing the needle during its displacement towards its initial position.

One then initiates the displacement of the needle 8 to its initial position (see FIG. 15). The hook 9 of the needle 8 engages the yarn 2 (see FIG. 13). The needle 8 consequently draws back the yarn.

Before the yarn 2 engages in the bobbin 1, the needle 8 is caused to rotate by one-quarter of a revolution about its own axis (see arrow F in FIG. 15), thus making it possible to lock the yarn with respect to the needle 8.

Figure 16:
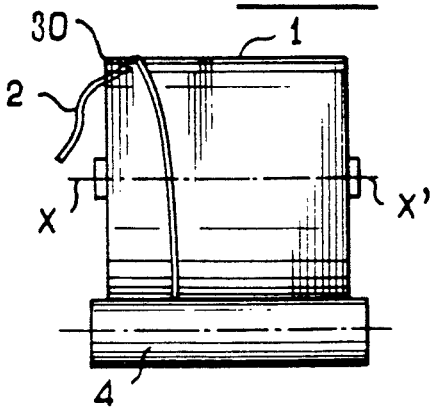
FIG. 16 is a side elevational view showing the fastening of the yarn end obtained after withdrawal of the needle.
Figure 17:
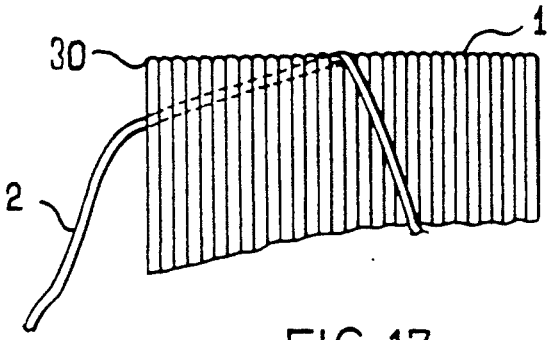
FIG. 17 is an enlarged side elevational view of the corner of the bobbin showing the fastening of the yarn end in the yarn windings.

During its subsequent travel, the needle 8 draws the yarn end 2 between the yarn windings in the corner 30 of the bobbin in order to hold it captive in said corner 30, as shown in FIGS. 16 and 17.

The device and the method which have just been described consequently permit efficacious fastening of the yarn end 2 to the bobbin without making use of a label which is liable to be torn away in the course of handling operations.

As can readily be understood, the bobbins can subsequently undergo a labeling or marking operation which has no yarn-fastening function.

It will be clearly apparent that the invention is not limited to the example of construction described in the foregoing and any number of modifications may be made in this example without departing from the scope of the invention.

Thus the nozzle 6 could have a finger which is capable of moving within the slit 11 in order to displace the yarn 2 towards the needle 8.

Moreover, the device could be completed by a device for automatically cutting the yarn end 2 which projects from the bobbin and/or by a device for tying a knot in said yarn end.

What is claimed is:

1. In a method for fastening a yarn end (2) on a bobbin (1), comprising:

a) placing the bobbin (1) horizontally on two spaced rotatable supports which support the bobbin along two lines parallel to the axis of the bobbin, b) creating with a suction nozzle a partial vacuum in a space located near the bobbin (1), the partial vacuum being sufficient to suck the yarn end (2) into said nozzle.

c) rotating said supports in a direction to cause the bobbin (1) to rotate in order to wind the yarn end (2) on the bobbin, and d) fastening said yarn end (2) on the bobbin (1);

the improvement wherein, while step (b) is being performed, rotating said supports in a direction opposite the first-mentioned direction to unwind the yarn end (2) so that this end can engage by suction to a sufficient extent within said space located near the bobbin (1), said fastening comprising the steps of inserting a needle provided with an end hook into a corner of the bobbin in the direction of the yarn which is engaged in the nozzle and transversely to said yarn; engaging the yarn in the hook of the needle; and withdrawing the needle from the bobbin in order to engage the yarn between the yarn windings of said corner of the bobbin.

2. Apparatus for fastening a yarn end on a bobbin, comprising a suction nozzle which opens in proximity to the bobbin, means for causing rotation of the bobbin in order to bring the yarn end opposite to the suction nozzle to suck the yarn end into the suction nozzle, means to move the suction nozzle toward and away from the bobbin, a support which carries a needle which carries an end hook, and means for moving the support such that said end hook moves through a corner of the bobbin in the direction of the yarn which is engaged in the suction nozzle to pick up the yarn end and then carries the yarn end back through said corner of the bobbin thereby to fasten the yarn end on the bobbin.

3. Apparatus as claimed in claim 2, wherein said suction nozzle opens on a top portion of the bobbin and the needle is disposed near a top corner of said bobbin.

4. Apparatus as claimed in claim 2, wherein the nozzle has a suction slit parallel to the axis of the bobbin and extending substantially over the entire length of said bobbin.

5. Apparatus as claimed in claim 2, said means to move the nozzle comprising means mounting the nozzle for pivotal movement about an axis parallel to the axis of the bobbin between a position in which a suction opening of said nozzle is spaced from the bobbin and a position in which said suction opening is substantially in contact with the bobbin.

6. Apparatus as claimed in claim 5, wherein the direction of displacement of the needle passes slightly beneath the yarn end in to the suction nozzle when the suction nozzle is spaced from the bobbin.

7. Apparatus as claimed in claim 6, wherein said end hook of the needle is upwardly directed.

8. Apparatus according to claim 6, wherein when said opening of the suction nozzle is substantially in contact with the bobbin, the yarn end which is maintained within said nozzle is applied against the needle.

9. Apparatus as claimed in claim 2, wherein said support of the needle comprises means for causing the needle to rotate about its axis by one quarter of a revolution at the time of displacement of said needle toward said initial position.

* * * * *